US010081485B2

(12) United States Patent
Cernokus et al.

(10) Patent No.: US 10,081,485 B2
(45) Date of Patent: Sep. 25, 2018

(54) PRODUCT PACKAGING

(71) Applicant: Apple Inc., Cupertino, CA (US)

(72) Inventors: Evan Cernokus, Campbell, CA (US); Lorraine Y. Tang, San Francisco, CA (US); Francesca Amor Delle Cese, San Francisco, CA (US); Mark T. Uyeda, Campbell, CA (US); Thomas Branton Watson, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/063,897

(22) Filed: Mar. 8, 2016

(65) Prior Publication Data

US 2016/0264297 A1 Sep. 15, 2016

Related U.S. Application Data

(60) Provisional application No. 62/130,486, filed on Mar. 9, 2015, provisional application No. 62/130,529, filed on Mar. 9, 2015, provisional application No. 62/151,766, filed on Apr. 23, 2015, provisional application No. 62/145,311, filed on Apr. 9, 2015.

(51) Int. Cl.

| | |
|---|---|
| ***B65D 85/40*** | (2006.01) |
| ***B65D 5/38*** | (2006.01) |
| ***B65D 5/50*** | (2006.01) |

(52) U.S. Cl.

CPC ..... *B65D 85/40* (2013.01); *B65D 5/38* (2013.01); *B65D 5/5035* (2013.01); *B65D 5/5061* (2013.01)

(58) Field of Classification Search

CPC ... A45C 7/00; A45C 7/005; A47F 7/02; A47F 7/022; B65D 5/38; B65D 5/50; B65D 5/5035; B65D 5/5061; B65D 25/10; B65D 85/40; B65D 5/36; B65D 6/06; B65D 25/00; B65D 25/22

USPC ..... 206/301, 804; 220/810–849

See application file for complete search history.

(56) References Cited

U.S. PATENT DOCUMENTS 1,666,668 A * 4/1928 Purchas ..... A47F 7/02 206/45.2
1,735,060 A * 11/1929 Shields ..... A45C 11/10 206/301

(Continued)

FOREIGN PATENT DOCUMENTS

CN 1108199 9/1995
CN 200939971 8/2007

(Continued)

OTHER PUBLICATIONS

International Search Report and Written Opinion, dated Aug. 1, 2016, for International Patent Application No. PCT/US2016/021367, filed Mar. 8, 2016.

*Primary Examiner* — Bryon Gehman
(74) *Attorney, Agent, or Firm* — Sterne, Kessler, Goldstein & Fox P.L.L.C.

(57) ABSTRACT

A product packaging is disclosed, including a rear panel, a front panel coupled to the rear panel, and an intermediate panel between the front panel and the rear panel. The intermediate panel may include a spacing segment that spaces a lip portion of the front panel away from the rear panel, and the intermediate panel may define a product-receiving recess of the packaging.

31 Claims, 19 Drawing Sheets

(56) References Cited

U.S. PATENT DOCUMENTS

| | | | | | |
|---|---|---|---|---|---|
| 2,288,421 | A | * | 6/1942 | Rathbun | A47F 7/03 206/6.1 |
| 2,327,301 | A | * | 8/1943 | Davis | A47F 7/022 206/301 |
| 2,874,828 | A | * | 2/1959 | Neugebauer | A47F 7/02 206/769 |
| 3,385,422 | A | * | 5/1968 | Lowry | B65D 25/10 220/847 |
| 3,442,415 | A | * | 5/1969 | Glass | B65D 43/168 220/847 |
| 4,919,259 | A | * | 4/1990 | Beaulieu | A45C 7/0054 16/225 |
| 5,069,332 | A | * | 12/1991 | Williams | A45C 7/0054 206/6.1 |
| D339,742 | S | * | 9/1993 | Walchek, Jr. | D3/203.3 |
| 5,467,894 | A | * | 11/1995 | Altonen | A47F 5/112 206/804 |
| 5,547,076 | A | * | 8/1996 | Doi | B65D 85/40 206/301 |
| 6,230,885 | B1 | | 5/2001 | Rochelo et al. | |
| 2006/0027664 | A1 | | 2/2006 | Lin | |
| 2009/0134223 | A1 | | 5/2009 | Matthews et al. | |

FOREIGN PATENT DOCUMENTS

| | | | |
|---|---|---|---|
| CN | 200939971 | Y | 8/2007 |
| CN | 102317173 | | 1/2012 |
| CN | 202175295 | | 3/2012 |
| CN | 102774547 | A | 11/2012 |
| CN | 203094615 | U | 7/2013 |
| CN | 103231855 | A | 8/2013 |
| CN | 203624123 | | 6/2014 |
| CN | 203997519 | U | 12/2014 |
| CN | 204173302 | | 2/2015 |
| DE | 20 2005 007 842 | U1 | 11/2006 |
| GB | 584244 | A | 1/1947 |
| JP | 6-312766 | A | 11/1994 |
| JP | 3005336 | | 12/1994 |
| JP | 3037023 | | 5/1997 |
| JP | 11-292054 | | 10/1999 |
| JP | 2004-59058 | A | 2/2004 |

* cited by examiner

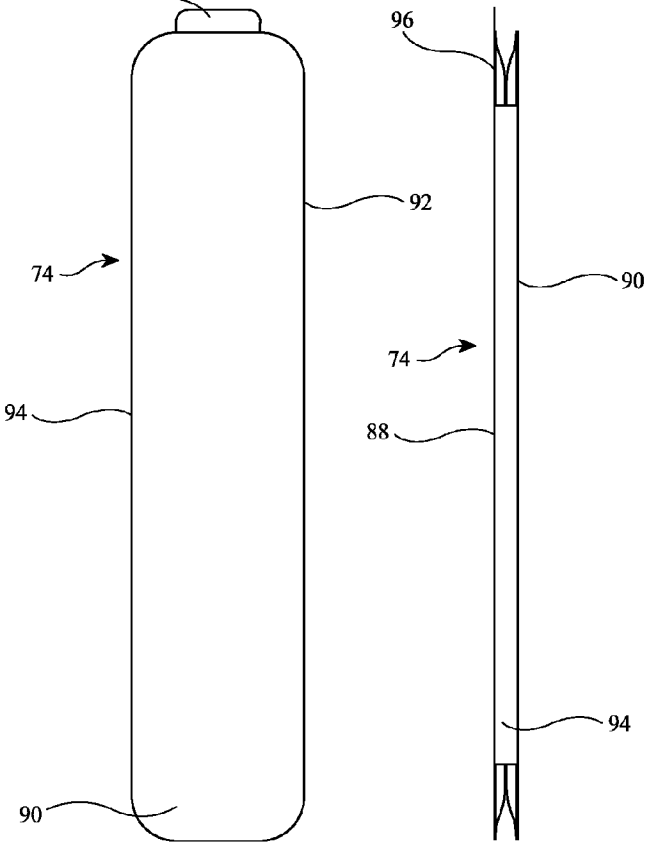
FIG. 10C
FIG. 10B
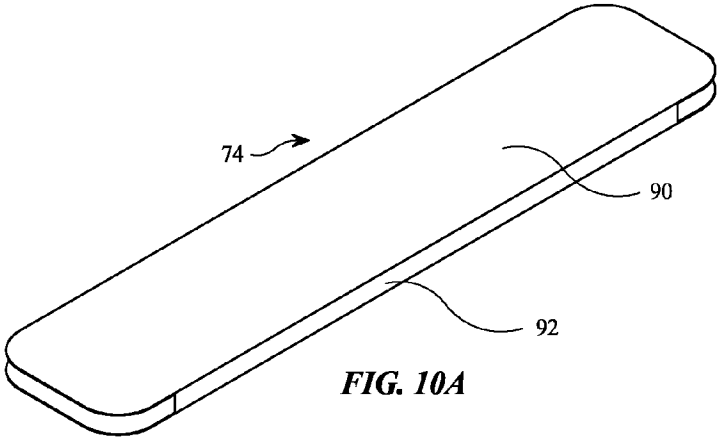
FIG. 10A

PRODUCT PACKAGING

CROSS REFERENCE

This application claims priority to U.S. Provisional Patent Application No. 62/130,486, filed Mar. 9, 2015, titled "Packaging System," U.S. Provisional Patent Application No. 62/151,766, filed Apr. 23, 2015, titled "Packaging System," U.S. Provisional Patent Application No. 62/130,529, filed Mar. 9, 2015, titled "Packaging," and U.S. Provisional Patent Application No. 62/145,311, filed Apr. 9, 2015, titled "Packaging," all of which are incorporated herein in their entirety by reference thereto.

FIELD

The described embodiments relate generally to packaging.

BRIEF SUMMARY OF THE INVENTION

Embodiments of the present invention relate to product packaging. In some embodiments the packaging includes a rear panel, a front panel coupled to the rear panel, and an intermediate panel disposed between the front panel and the rear panel. The intermediate panel may include a spacing segment that spaces a lip portion of the front panel away from the rear panel. Thus, the intermediate panel may define a product-receiving recess.

In some embodiments the packaging includes a first rear panel, a first front panel coupled to the first rear panel, and a first intermediate panel disposed between the first rear panel and the first front panel. The product packaging may also include a second rear panel, a second front panel coupled to the second rear panel, and a second intermediate panel disposed between the second rear panel and the second rear panel. Finally the product packaging may include a cover panel, a first connector panel, and a second connector panel, with the first connector panel coupled to the first rear panel and the second rear panel, and the second connector panel coupled to the second rear panel and the cover panel.

BRIEF DESCRIPTION OF THE DRAWINGS

The disclosure will be readily understood by the following detailed description in conjunction with the accompanying drawings, wherein like reference numerals designate like structural elements, and in which:

FIGS. 10A, 10B, and 10C show a product insert in a folded configuration according to some embodiments.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to a packaging system. Packaging systems according to embodiments of the present invention may be used for packaging items/products such as, for example, watches and watch bands (including smart watches and smart watch bands). Packaging systems as described herein may include a sleeve or elongated recess that forms a pocket into which an elongated item (like a watch band) may be slid, and retained therein. The item may be retained therein by, for example, a portion of the packaging around the perimeter of the recess that overlaps a portion of the item.

These and other embodiments are discussed below with reference to the figures. However, those skilled in the art will readily appreciate that the detailed description given herein with respect to these figures is for explanatory purposes only and should not be construed as limiting.

Figure 1:
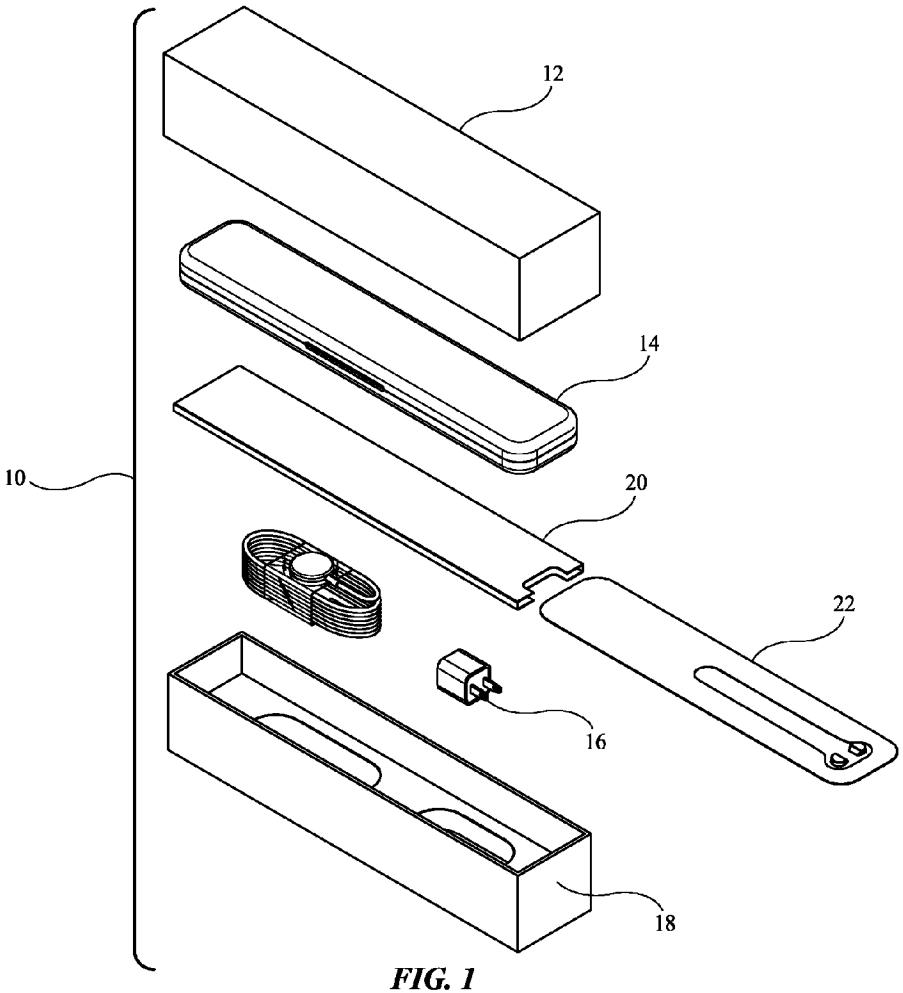
FIG. 1 is an exploded view showing a packaging system according to some embodiments.

FIG. 1 is an exploded view showing a packaging system 10. Packaging system 10 includes an upper box 12 and a lower box 18 that cooperate together to enclose the remaining parts. The lower box 18 includes a tray assembly having cavities that receive various accessory parts including for example cables and power adapters 16. The lower box also forms an area for receiving a document folder 20 and a product jewel case 14. Product jewel case 14 may for example include a product such as a watch. Document folder 20 may include various catalogs and information books about the product. It also may include a product insert 22 that slides into an opening 24 in document folder 20. Product insert 22 may carry one or more additional accessories (e.g., accessories that work with the product contained in the product jewel case 14). For example, in the case of a watch, product insert 22 may include an accessory 28 such as a watch band.

Figure 2:
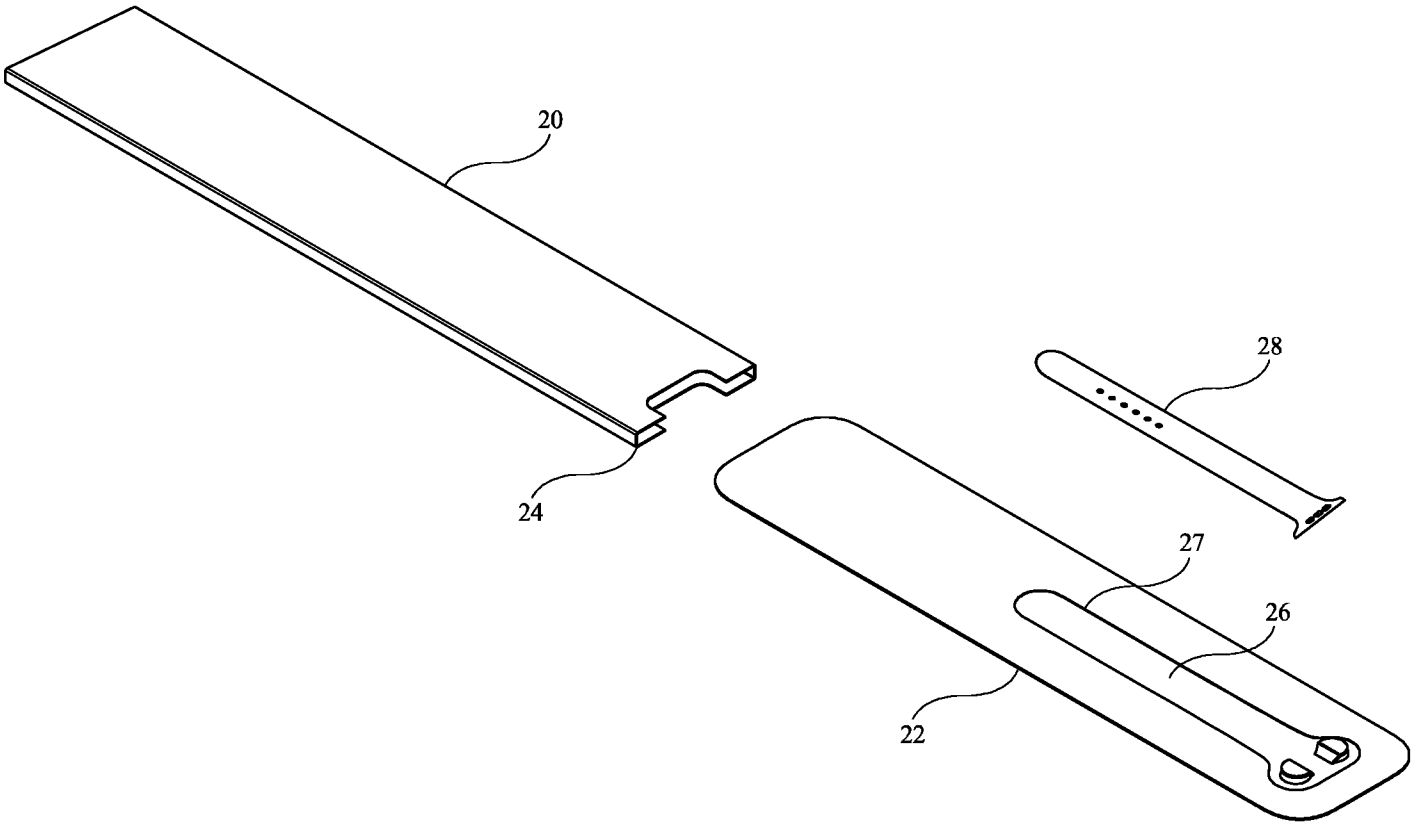
FIG. 2 shows a product insert and packaging components according to some embodiments.

As shown in FIG. 2, product insert 22 may include a recess 26 configured to receive accessory 28. Recess 26 may include a lip 27 that helps retain accessory 28 in recess 26 by overlapping a portion of accessory 28 when accessory 28 is received within recess 26. For example, lip 27 may extend over a peripheral edge of accessory 28. Lip 27 may for example be sized smaller than accessory 28 such that lip 27 retains accessory 28 within recess 26. In one example, lip 27 forms a flange or undercut area.

Figure 3B:
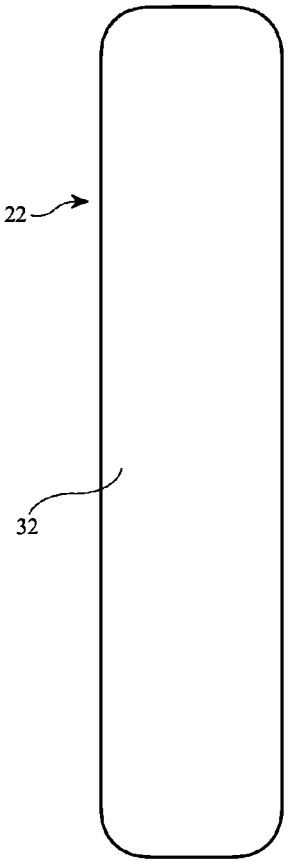
FIGS. 3A and 3B show front and rear sides of a product insert according to some embodiments.
Figure 3A:
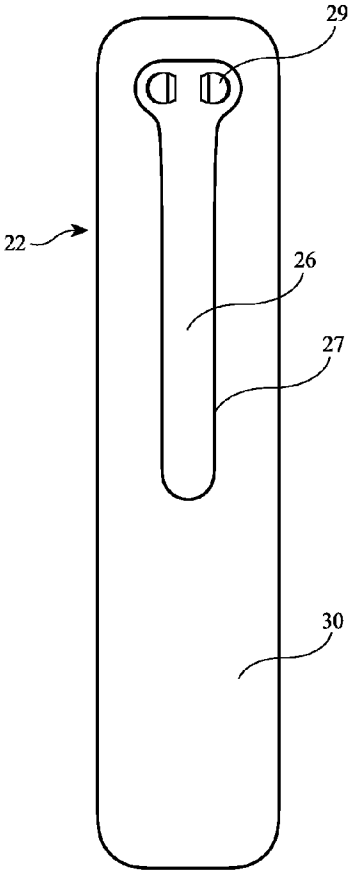

Recess 26 may additionally include retention members 29, as shown in FIG. 3A. Retention members 29 are configured to further aid in retaining accessory 28 within recess 26. For example, they may form a side surface for trapping accessory 28 within a defined space. Retention members 29 may fold up and form arms and the arms may additionally include a shape or undercut for holding accessory 28. In some embodiments, retention members 29 may include an adhesive layer 298. Adhesive layer 298 may add rigidity to retention members 29 when retention members 29 are folded up to form arms. In some embodiments, adhesive layer 298 may extend from retention members 29 onto areas of rear panel 200 that surround retention member 29, to increase integrity between retention members 29 and their surrounding areas. Adhesive layer 298 may be transparent. In some embodiments, product insert 22 is formed from a film or sheet. For example, but not limited to, paper sheets or cardboard. In some embodiments product insert is formed entirely of paper (with the potential exception of adhesive). In this way, product insert 22 can be entirely recyclable. All product inserts described herein may be formed entirely of paper, and which can provide the same benefits.

In some embodiments, product insert 22 may be formed from multiple sheets that are stacked together. As shown in FIG. 3, for example, in some embodiments the product insert may include a front panel 30 and a rear panel 32. Front panel 30 may include a cut out 26 that forms an opening and lip 27 used to retain accessory 28 in product insert 22, while still displaying a majority of accessory 28 through the opening (i.e., the majority of the viewable surface of accessory 28 from the perspective of the opening). Front and rear panels 30 and 32 may be adhered together. For example, an adhesive may be used between the panels.

Figure 4:
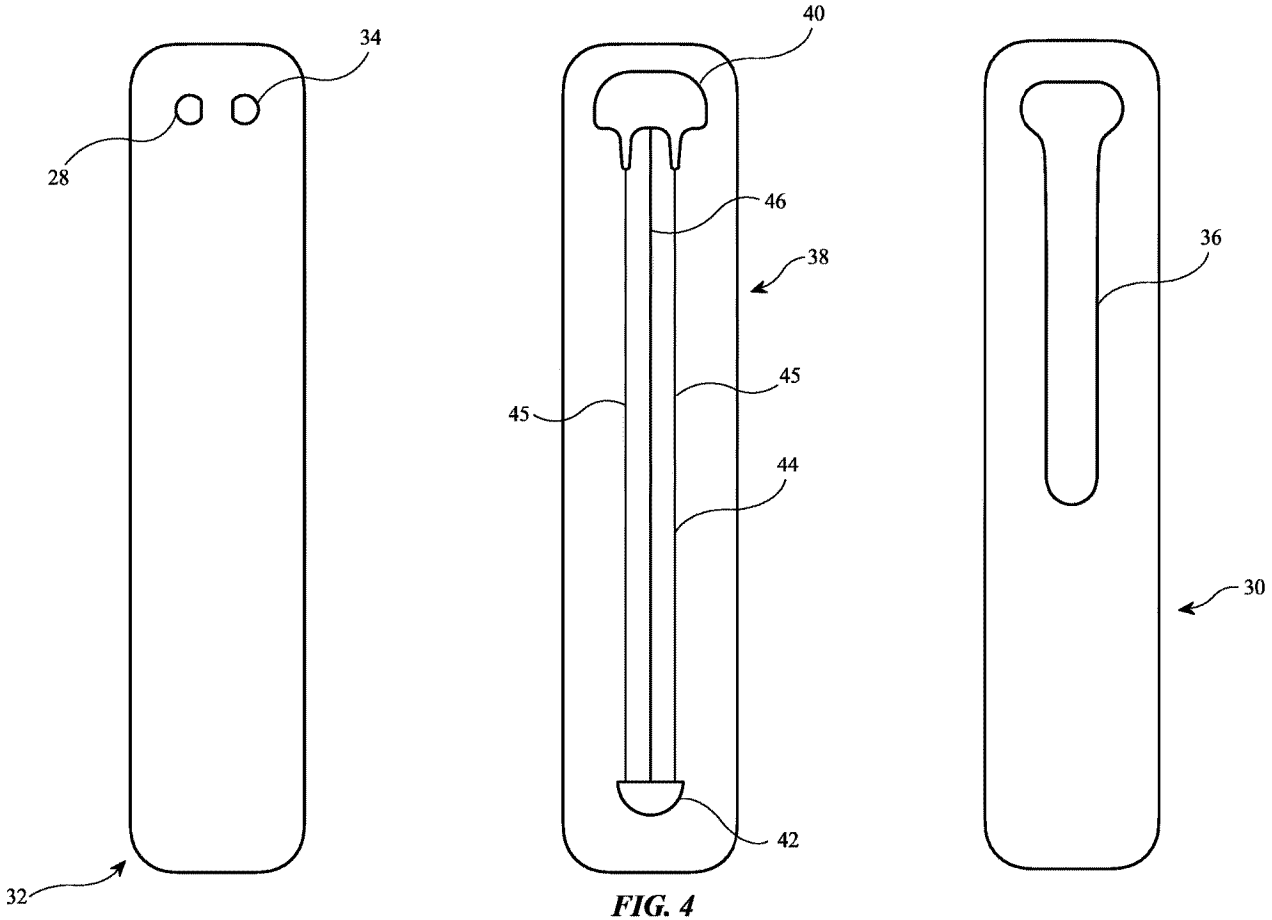
FIG. 4 shows product insert components according to some embodiments.

In some embodiments, product insert 22 may additionally include an intermediate layer such as intermediate panel 38 as shown in FIG. 4. In some embodiments, intermediate panel 38 may include one or more features that helps form recess 26. For example, intermediate panel 38 may include openings 40 and 42, and may further include depression 44. Depression 44 may be formed by scoring first and second score lines 45 and creating a bend at a central portion. To allow first and second score lines 45 to bend, intermediate panel 38 may be cut along a center line 46 between pairs of first and second score lines 45. In this way, areas between pairs of first and second score lines 45 may form side walls of recess 26.

Figure 16:
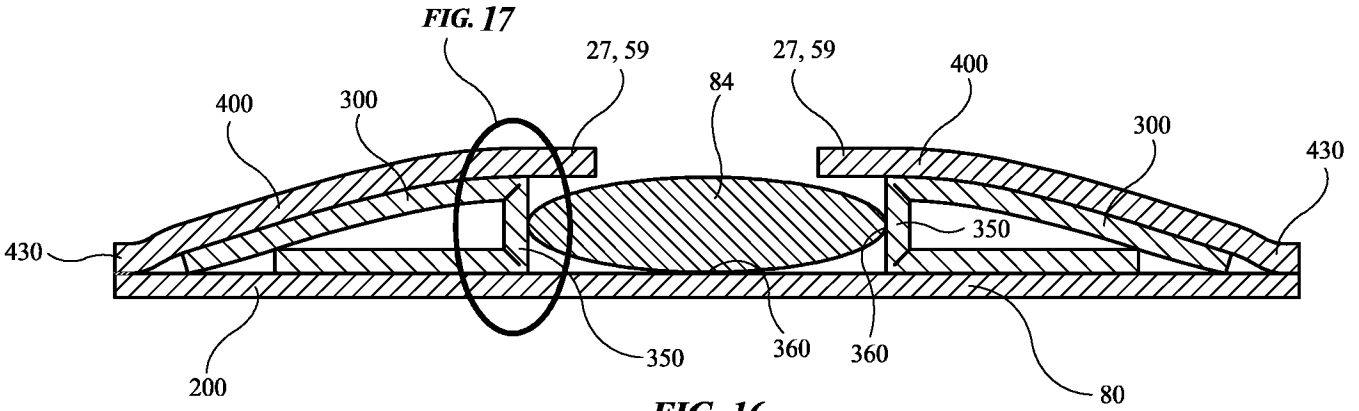
FIG. 16 shows a sectional view of a product insert according to some embodiments.
Figure 17:
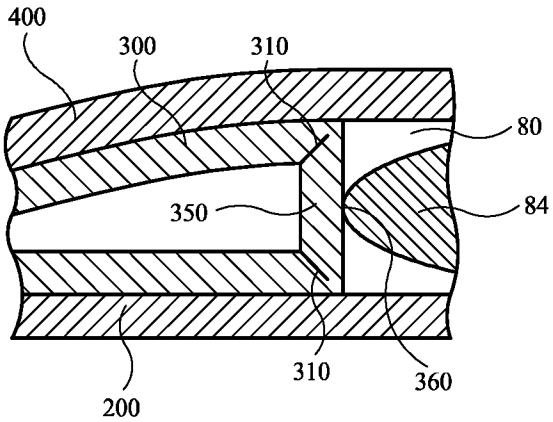
FIG. 17 shows a sectional view of a product insert according to some embodiments.

The three-part structure may come together to form product insert 22. For example, as shown in FIG. 4, intermediate panel 38 may be attached to rear panel 32, and front panel 30 may be attached to intermediate panel 38. In some examples, an adhesive may be placed between each of the layers. In some cases, the adhesive is placed around the perimeter and/or in areas that do not form part of recess 26 for receiving accessory 28. The recess portion of intermediate panel 38 is shaped to receive accessory 28 and lip 27 of front panel 30 is shaped to form a flange that extends inward of the recess portion. That is, the inner recess is wider than the distance between opposing sides of lip 27. FIGS. 16 and 17 show an example of this flange arrangement. FIGS. 2, 3A, and 3B show an embodiment of the product insert constructed from the three part structure shown in FIG. 4.

Figure 6A:
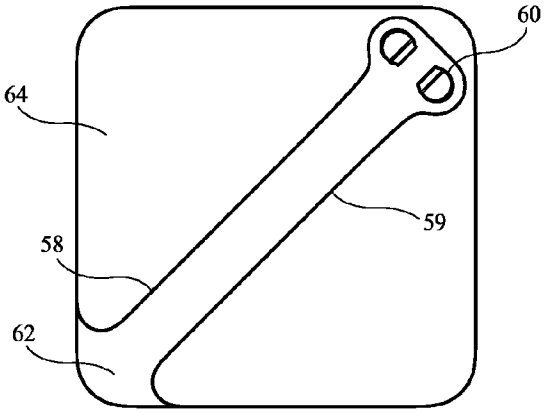
FIGS. 6A and 6B show front and rear sides of a product insert according to some embodiments.
Figure 6B:
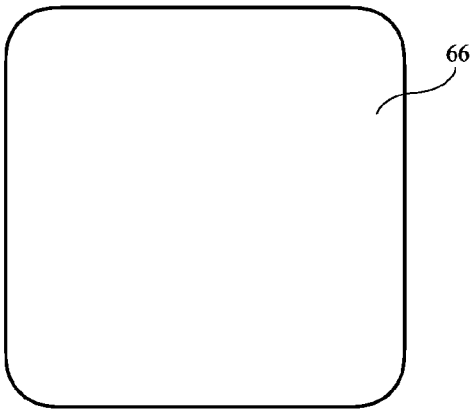
Figure 5:
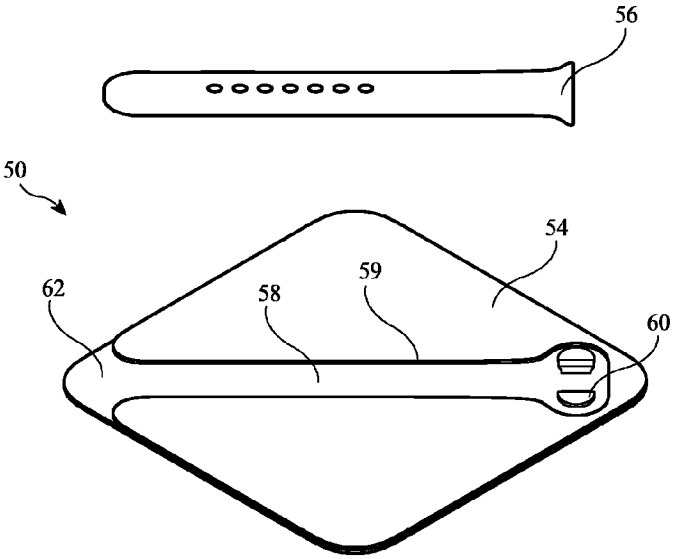
FIG. 5 shows a product insert and item according to some embodiments.
Figure 7:
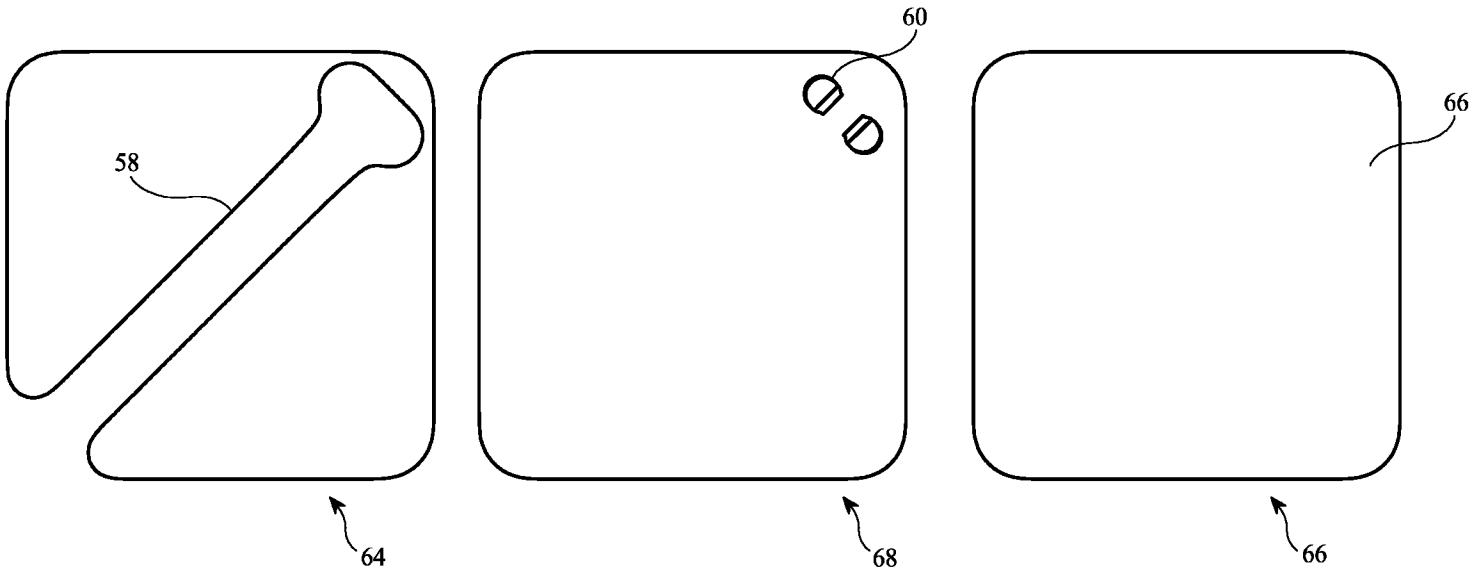
FIG. 7 shows product insert components according to some embodiments.

FIGS. 5, 6A, and 6B show another embodiment of a product insert. While FIG. 3 shows a longitudinally extending configuration (e.g., rectangular), FIGS. 5, 6A, and 6B show a square version 50. This embodiment has a similar construction as FIG. 2 including recess 58, lip 59, and retention features 60. It additionally includes an open area 62 at the end of recess 58. This helps a consumer remove accessory 56 from recess 58 (i.e., bend down on the corner thereby leaving the end of accessory 56 exposed). As shown in FIG. 7, in some embodiments, product insert having a square configuration has a three-part structure that forms a square version 50 of product insert. FIG. 7 shows a front panel 64, an intermediate panel 68, and a rear panel 66, which may be arranged together in a stacked configuration to form product insert 50. Front panel 64, intermediate panel 68, and rear panel 66 may have characteristics similar to those described above for product insert 22. In some embodiments, rear panel 66 is optional. FIGS. 5, 6A, and 6B show an embodiment of an assembled square version product insert 50.

Figure 8:
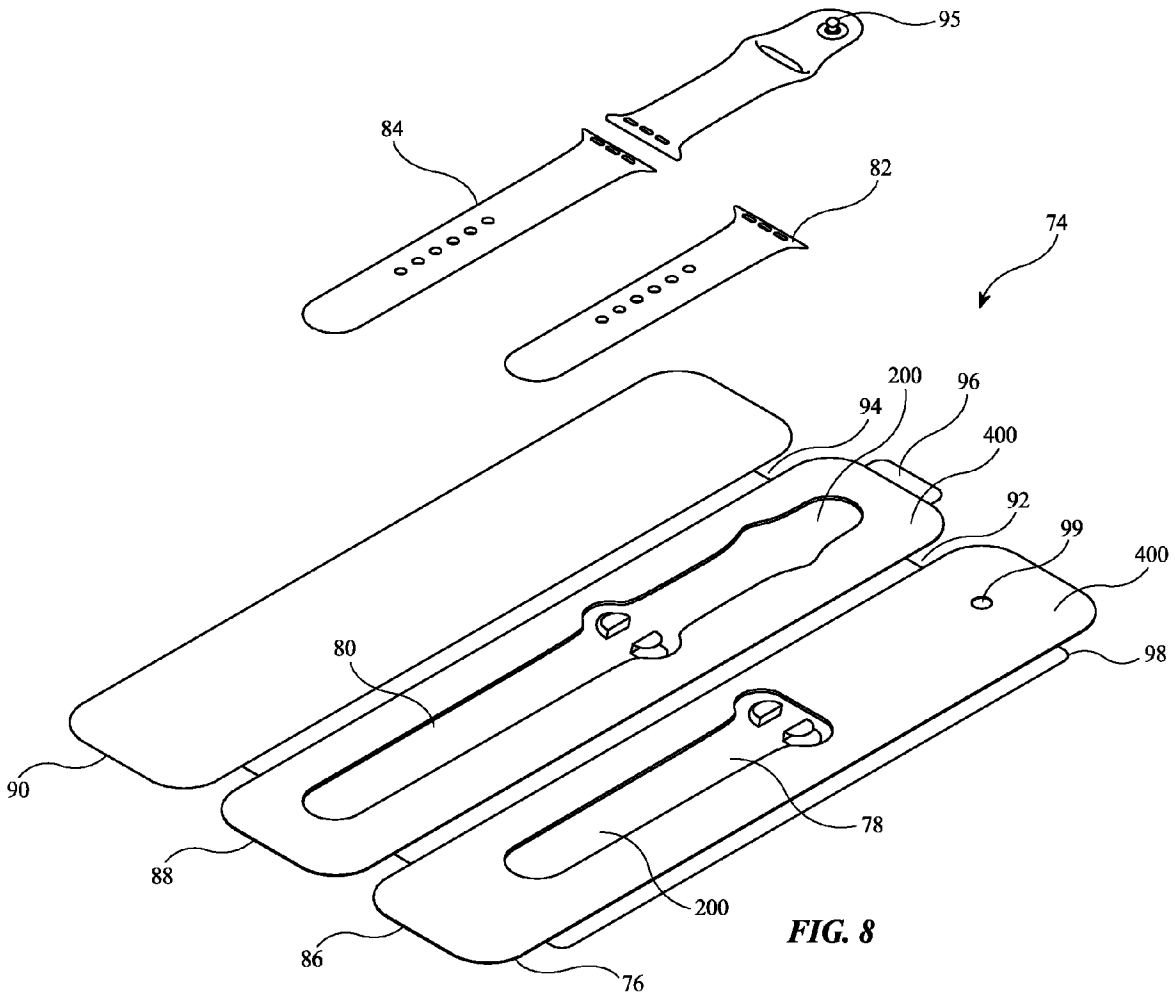
FIG. 8 shows a product insert and items according to some embodiments.

FIG. 8 shows another embodiment of a product insert 74. In this embodiment, product insert 74 includes multiple segments. The multiple segments are configured to fold relative to one another. In the embodiment shown in FIG. 8, product insert 74 includes three segments and may be considered a trifold. It should be appreciated, however, that any number of segments can be used, for example, a bi-fold. In some embodiments, product insert 74 has at least two states. The first state is an unfolded state which exposes the accessory retained therein, and the second state is a folded state that hides and contains the accessory therein (see, e.g. FIGS. 10A, 10B, and 10C). When folded, product insert 74 can be slid into a box (e.g., document folder 20, see FIG. 1).

FIG. 8 shows an exemplary embodiment of product insert 74. As shown, product insert 74 includes segments 86, 88, and 90, which are separated by sections 92 and 94. Sections 92 and 94 are configured to allow the segments 86, 88 and 90 to bend relative to each other. For example, they can be folded over one another to form a stacked configuration. Segments 86, 88, and 90 may or may not include a recess for receiving an accessory. In the illustrated example, the segment 86 includes a recess 78 and the segment 88 includes a recess 80. The two recesses can be similar or different. In the illustrated example, the recesses 78 and 80 are different. Recess 78 includes space for a first accessory and recess 80 includes space for a second accessory. In the case of a watch for example, the first recess 78 may include a short band 82 and the second recess 80 may include a long band 84. Product insert 74 may include additional features such as tab 96 and tab 98, which can be folded over the other segments to enclose the assembly or used to remove product insert 74 from document folder 20.

FIG. 8 an exemplary embodiment of a tri-fold structure of a product insert 74 with long band 84, short band 82, and protrusion 95. Opening 99 may receive protrusion 95 when the product insert is in the closed configuration. Opening 99 may include an adhesive or cushioning material such as silicone to hold the protruding metal portion 95 of item 82, 84. In some embodiments, product insert 74 includes an opening 99 in front panel 400. Opening 99 may be used to receive, for example, a protruding portion of item 82, 84, which may be, for example, a protruding metal part of a watch band (e.g., protrusion 95). To help minimize tarnishing in the case where protrusion 95 is a metal part formed of a precious metal, such as gold or silver (or any other material that may be susceptible to tarnishing) the inner surface of rear panel 200 exposed through opening 99 may have microfiber applied to it, to provide a soft, non-marring material for the protruding part of item 82, 84 to contact. Also, between front panel 400 and rear panel 200 an intercept compound may be applied that absorbs sulfur and other chemicals in the air that could promote tarnishing of the protruding metal portion of item 82, 84, thereby minimizing their free presence within product insert 74, particularly around protrusion 95 of item 82, 84. For example, the intercept compound may be applied to the inner surface of front panel 400 around opening 99. Further, opening 99 may include an adhesive or cushioning material such as silicone to hold the protruding metal portion 95 of item 82, 84.

Figure 9A:
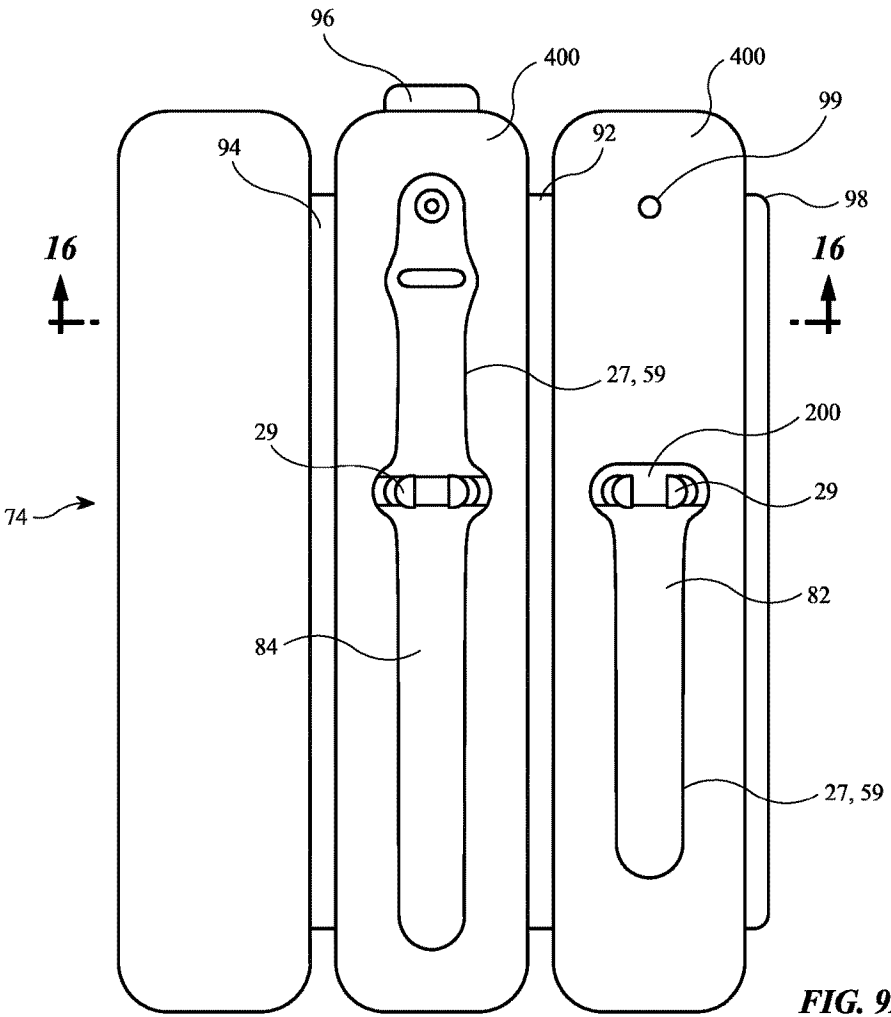
FIGS. 9A and 9B show front and rear sides of a product insert according to some embodiments.
Figure 9B:
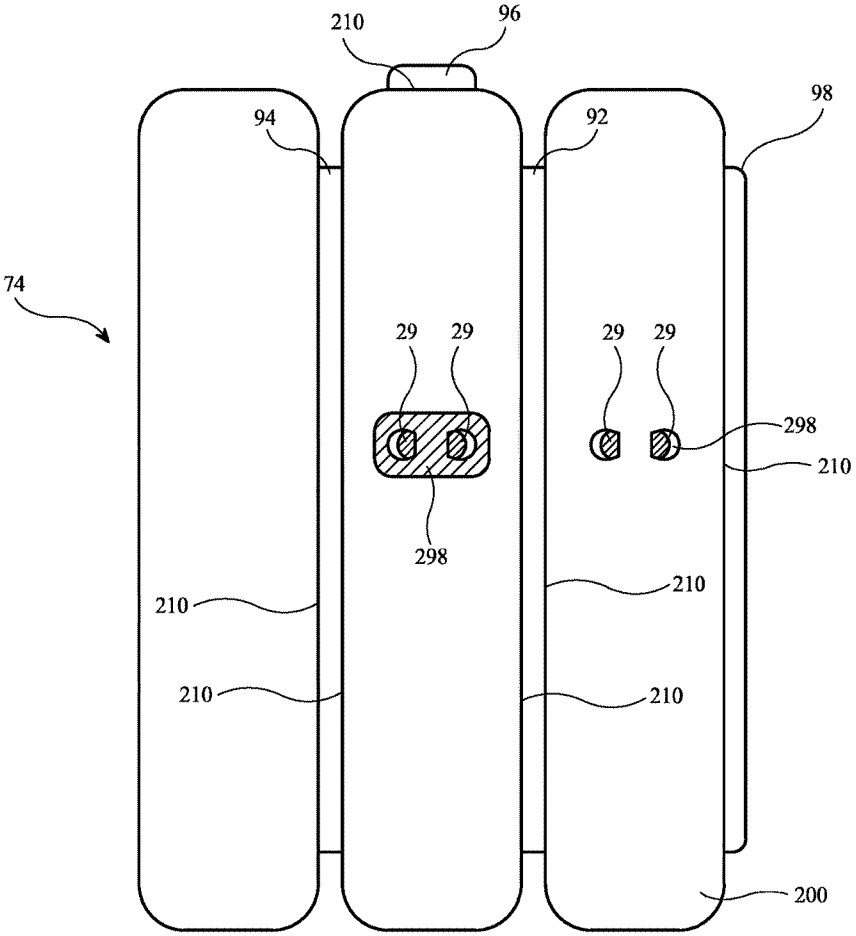

FIG. 9A shows an exemplary embodiment of a tri-fold structure of product insert 74 with long band 84 and short band 82 secured in the tri-fold structure. Retention members 29 may be die cut from the rear panel and may fold up and form arms together to secure products in the tri-fold product insert. FIG. 9B shows a rear view of the tri-fold structure of FIG. 8 with retention members 29 deployed. Retention members 29 may include adhesive layer 298 as shown in FIG. 9B. Adhesive layer 298 may make retention members 29 more rigid when folded to better secure item 82, 84.

Figure 18:
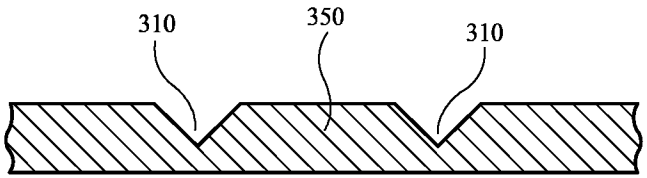
FIG. 18 shows a sectional view of a product insert according to some embodiments.

In some embodiments, rear panel 200 may be continuous, and may include score lines 210 at which rear panel 200 may fold, as shown in FIG. 9B. By folding at score lines 210, rear panel 200 can create the tri-fold structure of product insert 74. Score lines 210 may be formed by compressing and/or deforming the material of rear panel 200 along score lines 210 to create a localized area that is less resistive to folding than its surrounding area. This promotes clean folds along score lines 210. An example score cross-section is shown in FIG. 18. In some embodiments front panel 400 and intermediate panel 300 may be formed in discrete sections, corresponding to one or more of segments 86, 88, and 90. When assembled together, the discrete sections of front panel 400 and intermediate panel 300 may be linked together by connection to rear panel 200 and each other.

Figure 11C:
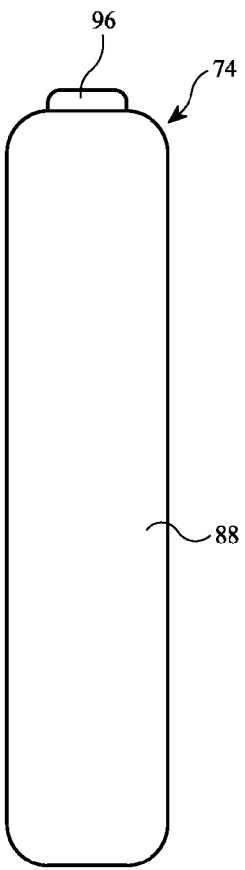
FIGS. 11A, 11B, and 11C show a product insert transitioning to a folded configuration according to some embodiments.
Figure 11B:
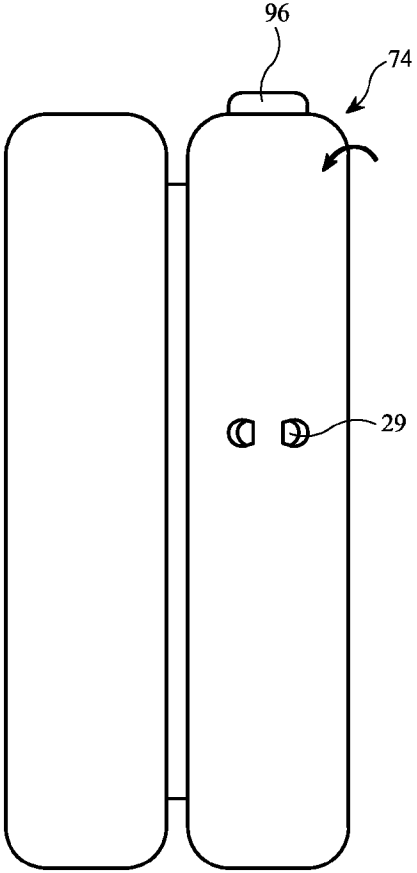
Figure 11A:
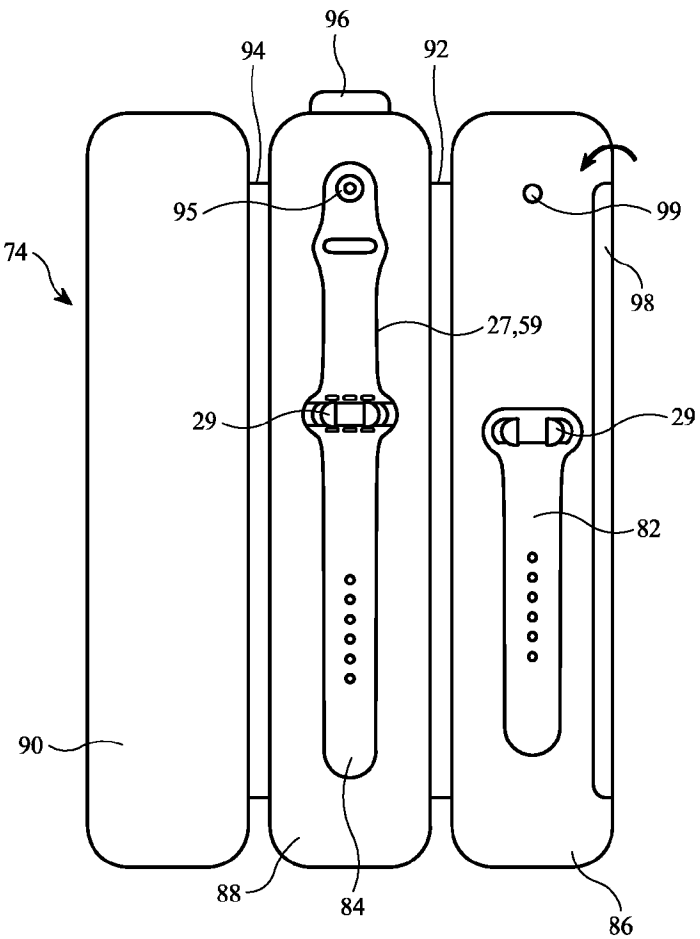

FIGS. 10A, 10B, and 10C show tri-fold insert 74 in the folded configuration. FIGS. 11A, 11B, and 11C demonstrate a method of folding the insert. In some embodiments, the method begins by folding segment 86 on to segment 88. Tab 98 aligns with tab 94 to make tri-fold insert 74 more rigid. Next, segment 90 is folded onto the rear of segment 86. In this way, intermediate panels 94 and 92 are exposed as shown in FIGS. 10A and 10C.

Figure 12:
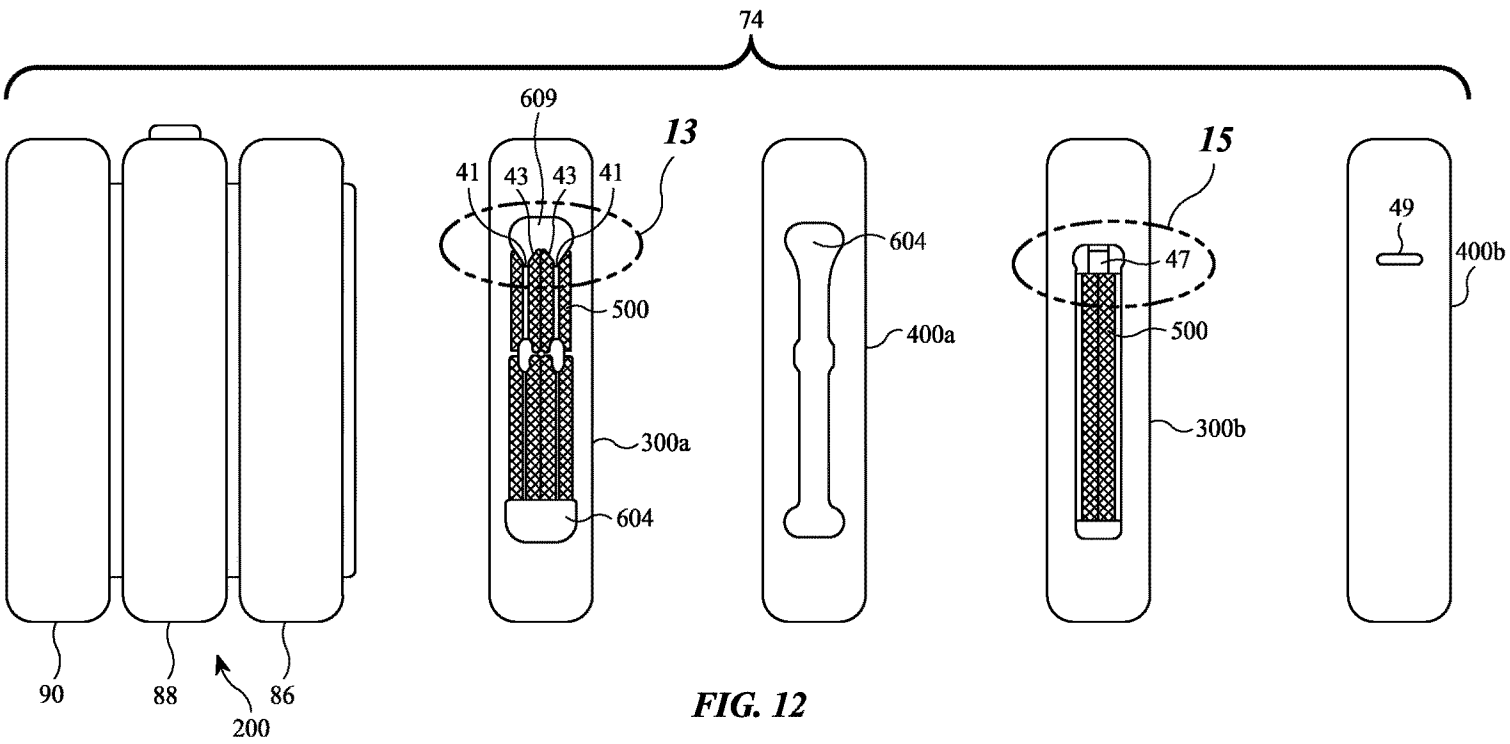
FIG. 12 shows product insert components according to some embodiments.
Figure 13:
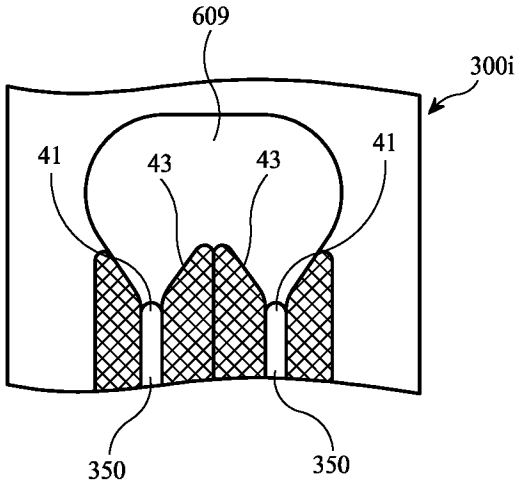
FIG. 13 shows a detailed view of a product insert according to some embodiments.
Figure 14:
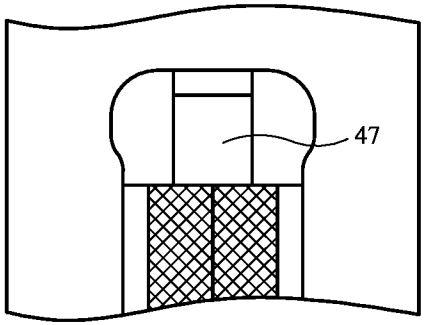
FIG. 14 shows a detailed view of a product insert according to some embodiments.

In some embodiments, product insert 74 is formed in a layered structure, having, for example, three panels layered together: rear panel 200, intermediate panels 300 (e.g., 300*a* and 300*b*), and front panels 400 (e.g., 400*a* and 400*b*) (see, e.g., FIG. 12). Each of rear panel 200, intermediate panels 300, and front panels 400 may be formed of a paper-based material, such as cardstock or paper. FIGS. 12-18 show embodiments of the present invention assembled using multiple sections. FIG. 12 shows rear panel 200, two intermediate panels 300*a* and 300*b*, and two front panels 400*a* and 400*b*. With reference to the three panels used to assemble the second segment 88 of tri-fold insert 74, panel 300*a* is located between panels 400*a* and 88 in the assembled product. Panel 300*a* may include folded features to create recess 26. FIG. 13 presents a detailed view of one end of intermediate panel 300*a*. Recess 26 is created by folding tabs 43 under intermediate panel 300*a*. This creates recess 26 having side walls 350 terminating at ends 41. In some embodiments, the contours of tabs 43 mirror the contours of recess 609 to create a smooth edge. In some embodiments ends 41 are rounded to provide a soft, non-marring surface contacting item 82, 84 when item 82, 84 is inserted into recess 26. Once intermediate panel 300*a* is assembled, front panel 400*a* may be secured to rear panel 200 with intermediate panel 300*a* secured in between to form second segment 88.

In some embodiments, first segment 86 may also include intermediate panel 300*b* and front panel 400*b*. Intermediate panel 300*b* may be assembled in a similar manner as intermediate panel 300*a*. Right intermediate panel 300*b* may further include tab 47 (see FIG. 14). Tab 47 may be folded under intermediate panel 300*b* before intermediate panel 300*b* is placed between rear panel 200 and right front panel 400*b* to form first segment 86. In this way, tab 47 may elevate front panel 400*b*. When product insert 74 is folded, the additional elevation of front panel 400*b* may provide additional cushioning of item 82, 84 contained in the product-recess 26 on panel 88. For example, item 82, 84 may include a metal clasp for a watch band. This clasp may include two metallic parts. The additional cushioning provided by the elevation of front intermediate panel 400*b* may reduce the movement of the metallic parts to reduce the potential for surface marring.

FIGS. 12 also shows a method of assembling a product insert 74 according to some embodiments. In FIG. 12 the three panels of product insert 74 are shown: rear panels 200 is shown face up, front panels 400*a* and 400*b* are shown face down, and intermediate panels 300*a* and 300*b* are shown face down. Each of these panels is die cut into a rough outer shape. Front panels 400*a* and 400*b* and intermediate panels 300*a* and 300*b* may also be die-cut to form one or more finished inner shapes 604. Adhesive strips 500 may be applied to the rear of intermediate panels 300*a* and 300*b*. Adhesive may also be applied to front panels 400*a* and 400*b* and rear panel 200 in areas where the panels will connect to each other, intermediate panels 300, or themselves. Adhesive (e.g., adhesive strips 500) may be applied before or after die-cutting. Adhesive may be, for example, tape (e.g., double-sided tape), and may have a release liner on one side that can remain in place to minimize unintended adhesion until the tape is ready to be used, at which point the release liner can be removed.

Rear panel 200, intermediate panels 300*a* and 300*b*, and front panels 400*a* and 400*b* may be scored and/or partially cut (e.g., mitre cut, such as the V-mitre cut described above) along lines along which they will be folded, as described above. For example, score lines or V-mitre cut lines 310 are shown in an embodiment of intermediate panel 300 in FIG. 15. The scores and cuts will facilitate clean, accurate, and precise folds later in the assembly process.

To prepare intermediate panel 300, its flaps 320 are folded along mitre-cut lines 310 and adhered back on other portions of intermediate panel 300 to form the spacing segment 350, as shown in FIG. 16. Prepared intermediate panel 300 may then be adhered to front panel 400. Intermediate panel 300 may be placed over front panel 400 and adhered thereto, such that inner portions of front panel 400 inner openings overlap openings of intermediate panel 300 as described above, particularly along spacing segments 350 (e.g., by lip 27, 59 overhanging spacing segment 350 as shown in FIG. 16).

Adhered-together intermediate panel 300 and front panel 400 may then be adhered to rear panel 200. This may be done by adhesive, and/or by a welding operation along the intended periphery of the finished product insert 74. In some embodiments, centrally-located adhesive strips 500 (that is, adhesive strips not at a boundary of the intended finished product insert 74) are used to fix adhered-together intermediate panel 300 to front panel 400, and then portions of the rear panel 200-intermediate panel 300-front panel 400 assembly that are intended to form a periphery 430 of the laminated segments of the finished product insert 74 may be welded together (e.g., by a high-frequency welding operation).

The welded-together assembly of rear panel 200, intermediate panel 300, and front panel 400 may then be die cut together around the periphery of product insert 74 to give product insert 74 its final shape. The die cuts may be at the outer edge of the welded portion, so that the outer edges of product insert 74 are welded, thereby minimizing the susceptibility of the welds to delaminate, and providing a crisp, clean edge.

In some embodiments assembled rear panel 200 may be flat, while front panel 400 may be curved, so that rear panel 200 and front panel 400 are separated within their outer borders. This is represented in the cross-sectional view in FIG. 16, taken along line 16-16 of FIG. 9A. This separation may provide space within which item 82, 84 may be retained. To maintain and promote this separation, intermediate panel 300 may form spacing segments 350, which also may act as bumpers inhibiting lateral movement of an item (e.g., accessory 82 or 84) retained within recess 78 or 80. Spacing segments 350 may be formed between and by two closely-spaced fold lines 310. FIG. 17 is an enlarged view of portion 24 of FIG. 16.

Additionally, in some embodiments an additive 360 may be placed between item 82, 84 and rear panel 200, spacing segments 350, or front panel 400, to further secure or protect item 82, 84. For example, an adhesive layer may be applied to prevent the lateral movement of item 82, 84 in product insert 22. Additive 360 may also include a shock-absorbing material such as silicone to protect item 82, 84 from excessive vibration. Additive 360 may protect item 82, 84 by providing a soft, non-marring surface against which to rest, and may help maintain item 82, 84 in position by providing a frictional or adhesive force against item 82, 84.

In some embodiments, the maximum distance between front panel 400 and rear panel 200 is small (e.g., less than 2 millimeters). This may be to more closely constrain movement of an item 82, 84 retained therebetween. To accurately maintain such small distances, in some embodiments fold lines 310 that form spacing segments 350 therebetween are formed as cuts 310 (e.g., V-mitre cuts) that remove some, but not all, material along fold line 310 (see, e.g. FIG. 15). Cuts 310 remove material from intermediate panel 300 (as opposed, for example, to compressing or deforming it, as with a score line). Removing material for cuts 310 helps to form a clean, accurate fold, and minimizes or eliminates bunching up of material that may be attendant to simply folding without a cut, or along a score line. Since fold lines 310 may be close together, bunching or other imprecise deformations may interfere with each other or have more of a visual or operative impact on intermediate panel 300 than may be present in folds spaced farther apart. Removing material for cuts 310 helps minimize or eliminate such bunching or other imprecise deformations, to result in a clean, consistent look and operation. As shown in FIGS. 16-18, in some embodiments, cuts 310 create fold lines which enable intermediate panel 300 to be folded back on itself. Adhesives 322 may also be applied to the fold areas to secure the flaps.

Cuts 310 may be formed in a V-shape, to form V-mitre cuts 310. For example, FIG. 18 shows a cross-section of a portion of intermediate panel 300 in an unfolded configuration, including a pair of V-mitre cuts 310. FIG. 17 shows this portion in a folded configuration assembled within a portion of product insert 74. When folded, opposing sides of the V-shape come together to form a clean corner, as shown in FIG. 17. This provides a flat, consistent spacing segment 350, which can help promote consistent retention of item 82, 84, and smooth sliding of item 82, 84 into and out of recess 78, 80, avoiding sticking, misalignment, or a fit that is too tight or too loose.

Figure 15:
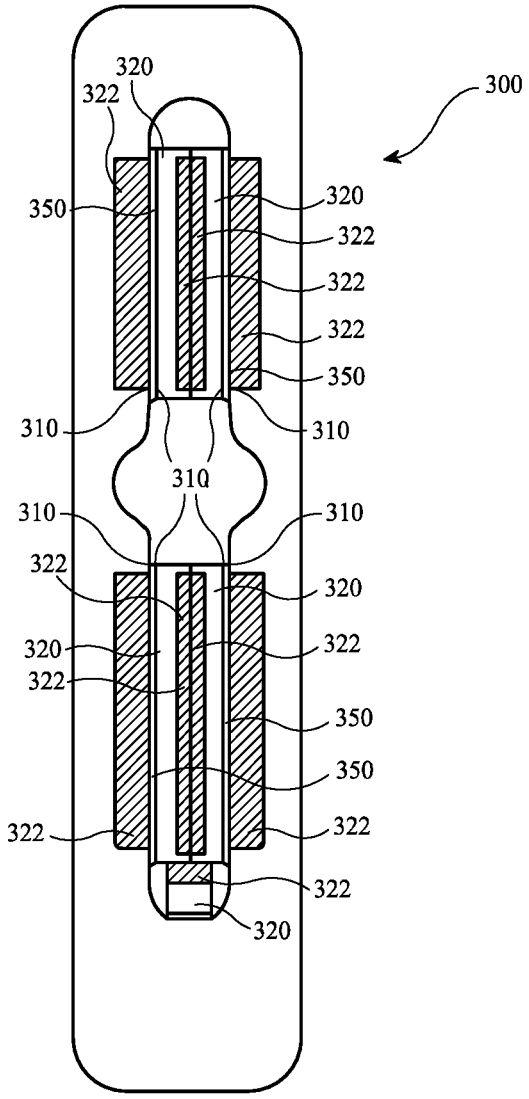
FIG. 15 shows a product insert component according to some embodiments.

In some embodiments, cuts 310 may not extend continuously across the entirety of intermediate panel 300; they may be selectively cut (e.g., selectively V-mitred). For example, as shown in FIG. 15, cuts 310 extend only along portions of intermediate panel 300 (e.g., along the sides of areas corresponding to recesses 78, 80 of product insert 74, where they are used to form spacing segments 350. To achieve this, a cutting tool may be lowered into intermediate panel 200, may travel along intermediate panel 300 for only the length of fold line 310 to thereby form cut 310, and may be raised from intermediate panel 300.

To maintain the folded positions of spacing segment 350, intermediate panel 300 may be adhered to itself. For example, to form spacing segment 350, a flap portion 320 of intermediate panel 300 adjacent to spacing segment 350 may be folded over and adhered to a portion of intermediate panel 300 on the other side of spacing segment 350. This may form a three-sided, triangular cross-sectional shape (see, e.g., FIG. 17). FIG. 15 shows flap portions 320 in an unfolded configuration along with and adhesives 322. In some embodiments, instead of or in addition to being adhered to other parts of intermediate panel 300, flaps 320 may be adhered to other panels (e.g., front panel 400 or rear panel 200). For example, flaps 320 may be adhered to rear panel 200 where they contact. Elements of product insert 74 may be adhered together by, for example, tape (e.g., double-sided tape) or glue, or by high-frequency welding. High-frequency welding provides a strong bond and a clean edge, avoiding potential exposed tape or glue.

In some embodiments rear panel 200 and front panel 400 (and optionally intermediate panel 300) are adhered together about the peripheries 430 of front panel 400 portions. Front panel 400 and rear panel 200 may be adhered together by, for example, tape or glue, or by high-frequency welding. High-frequency welding provides a strong bond and a clean edge, avoiding potential exposed tape or glue. In some embodiments the panels are adhered together by a 2-millimeter-wide weld about their shared peripheries. To facilitate welding, one or more of rear panel 200, intermediate panel 300, and front panel 400 may be coated with a BOPP (biaxially oriented polypropylene) film at least in the areas to be welded together. Thus, when assembled, rear panel 200, intermediate panel 300, and front panel 400 together form recesses (e.g., recesses 26, 58, 78, 80) within which items (e.g., accessories 82, 84) may be securely retained, and easily inserted or removed, without relying on permanent or difficult-to-remove securing methods such as tape, straps, clamshells, ties, or other separate securing mechanisms.

Figure 19:
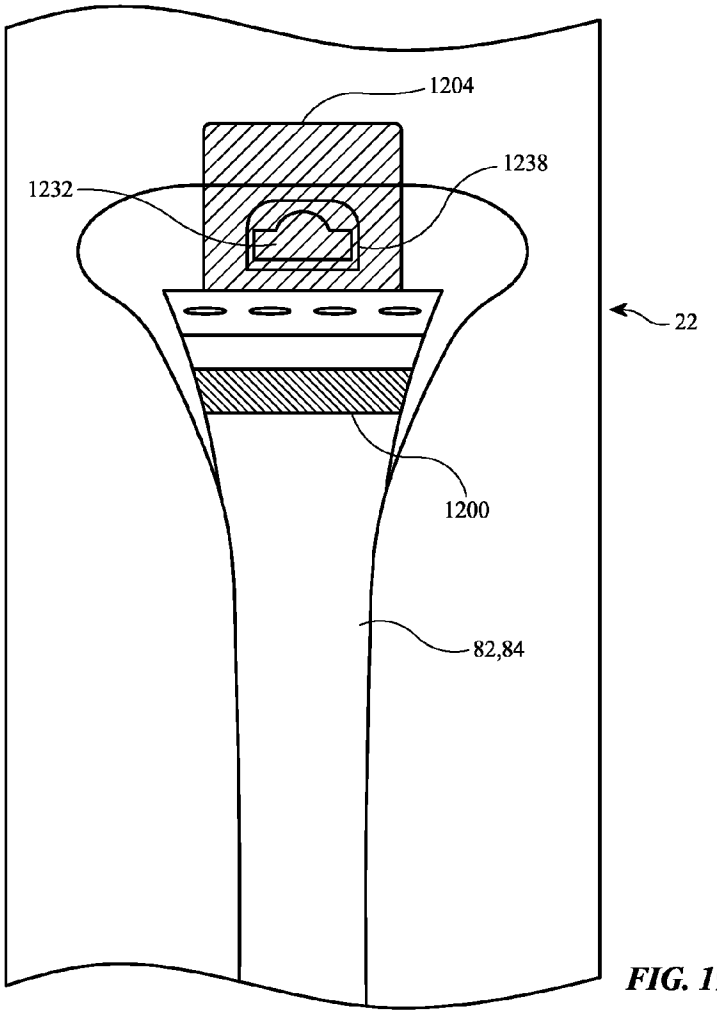
FIG. 19 shows a product packaging film with a product and product insert according to some embodiments.

Further, in some embodiments portions of a packaged product may be protected with films disposed around or between portions of the packaged product. For example, as shown in FIG. 19 such films may be positioned at areas where the packaged product may contact the packaging, other portions of the packaged product, or other items. Some embodiments described herein include one or more protective films 1200 disposed between such parts, to minimize movement and direct contact therebetween. In some embodiments, protective films 1200 may include a tab pull tab 1204. Pull tab 1204 may be used to remove item 82, 84 from product insert 22 as well as to protect its surface while within product insert 22. Protective films (e.g., protective film 1200, pull tab 1204) may be used similarly in other packaging embodiments described herein, such as product insert 74. Protective films 1200 as described herein may be formed of a relatively soft material, such as, for example, a polycarbonate (e.g., Lexan®), silicone, polypropylene, or as Mylar®. This can help keep the packaged product in optimum conditions by protecting its surface.

FIG. 19 shows item 82, 84 in recess 26 of product insert 22. Protective film 1200 is wrapped around item 82, 84 and is also attached to pull tab 1204. Pull tab 1204 may be adhered to rear panel 200 with adhesive 1232. Adhesive 1232 may be a dual-layer adhesive. The layer of adhesive 1232 in contact with pull tab 1204 may be a high tack adhesive while the layer of adhesive 1232 in contact with rear panel 200 may be a low tack adhesive. Using a low tack adhesive for rear panel 200 and a high tack adhesive for pull tab 1204 promotes clean removal of adhesive 1232 from product insert 22 when pull tab 1204 is pulled and removed. Further, the shape of the adhesive area may be controlled by using adhesive deadening 1238. Adhesive deadening 1238 inhibits adherence of the adhesive to surfaces covered with adhesive deadening 1238. Precise control of the both the area and shape of the adhesive can ensure that a tailored amount of force is required to remove pull tab 1204. Additionally, the character of the adhesive, including the shape of the adhesion, may contribute to a more pleasing sound as pull tab 1204 is removed.

Figure 21:
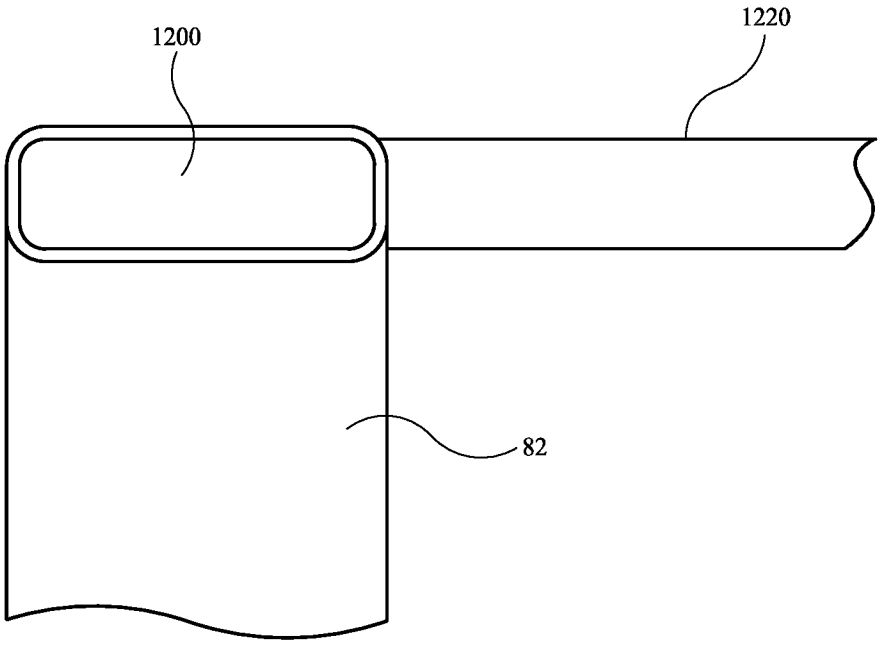
FIG. 21 shows a product packaging film according to some embodiments.

Protective films 1200 may adhere to item 82, 84 by, for example, an applied adhesive, a static attraction, or a natural tackiness of protective film 1200. As shown in FIG. 21, protective films 1200 may include wings 1202 that can be used to wrap around portions of item 82, 84, to better secure film 1200 to item 82, 84 (e.g., by contacting more surface area, by attaching to more planes of item 400 extending in different directions).

Protective film 1200 can cover multiple disparate surfaces of item 500 with a single protective film 1200. This can help promote proper alignment when applying protective films 1200, can help retain protective films 1200 on item 82, 84, and can help minimize the number of protective films 1200 used when otherwise multiple protective layers would be applied. For example, as shown in FIG. 20, protective film wings 1202 can sequentially wrap around item 82*a* to protect it from contacting item 82*b*.

In some embodiments, protective films 1200 may include a pad 1220 to provide an increased barrier and cushioning between parts of item 82, 84, relative to that which would be provided by base film 1210 alone (see FIG. 21). In some embodiments, pad 1220 is compression molded (e.g., formed of compression-molded silicone that is compression-molded into a void or discontinuity in base film 1210). In some embodiments base film 1210 is a polycarbonate film (e.g., Lexan®). In some embodiments, pad 1220 is injection-molded into a void in base film 1210.

In some embodiments, pad 1220 is positioned so that when protective film 1200 is applied to item 82, 84, pad 1220 is positioned between a magnet of item 82, 84 and another portion of item 82, 84 (e.g., between a magnet of a watch band and another part of the band itself). This can help to allow the magnet to attract portions of the band through pad 1220, while protecting the attracted portions of the band from direct contact with the magnetic portion, thereby minimizing potential for marring or other surface imperfections.

Figure 20:
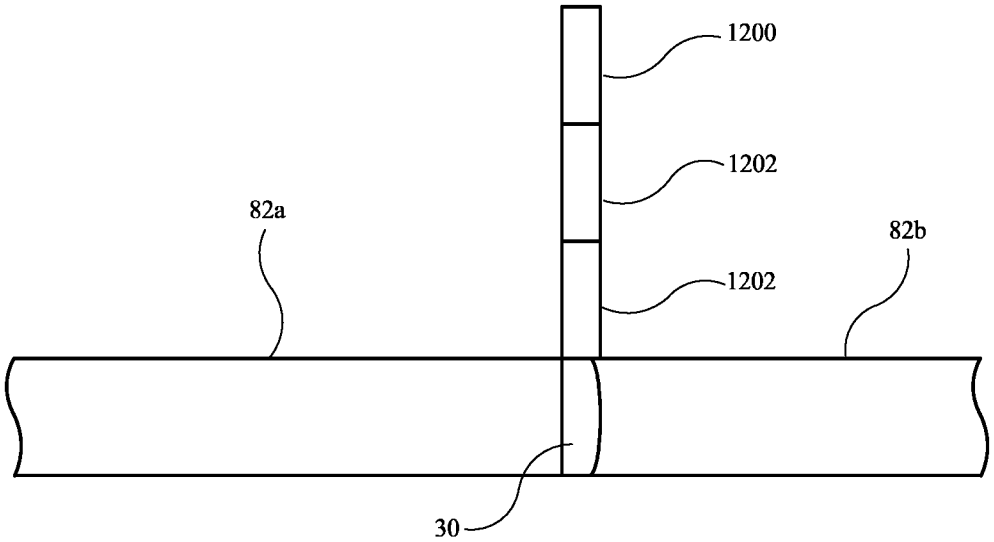
FIG. 20 shows a product packaging film according to some embodiments.

FIG. 20 shows an exemplary use of protective film 1200 of FIG. 21. As shown, one side of pad 1220 may be applied to item 82, 84 located on for example, a magnetic portion thereof. Another item or portion of item 82, 84 can be positioned on the other side of pad 1220. In some embodiments magnetic attraction between item 82, 84 and the other item or portion of item 82, 84 may hold protective film 1200 in place by magnetic attraction through pad 1220. Protective film 1200 may then be wrapped around item(s) 82, 84 and adhered to item(s) 82, 84 and itself. A portion of protective film 1200 may be creased so as to protrude away from item 82, 84, providing a convenient pull tab for a user to pull to remove protective film 1200. One of skill in the art will recognize that the product inserts described herein can be used in a variety of packaging systems, including those disclosed in U.S. patent application Ser. No. 29/519,821, filed Mar. 9, 2015, titled "Packaging with Accessories," which is incorporated herein in its entirety by reference thereto. Further, U.S. patent application Ser. No. 29/519,936, filed Mar. 9, 2015, titled "Packaging with Accessory," discloses packaging inserts in accordance with the present invention, and is incorporated herein in its entirety by reference thereto.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The detailed description section is intended to be used to interpret the claims. The abstract section may set forth one or more but not all exemplary embodiments of the present invention as contemplated by the inventor(s), and thus, are not intended to limit the present invention and the appended claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. Product packaging, comprising:

a rear panel;

a front panel coupled to the rear panel; and an intermediate panel disposed between the front panel and the rear panel, wherein the intermediate panel comprises a spacing segment that spaces a lip portion of the front panel away from the rear panel, wherein the intermediate panel defines a product-receiving recess, wherein the front panel comprises an opening over a majority of the product-receiving recess, and wherein the lip portion overhangs the product-receiving recess.

2. The product packaging of claim 1, wherein the lip portion overhangs the spacing segment.

3. The product packaging of claim 1, wherein the opening exposes a majority of the product-receiving recess when the product-receiving recess does not contain a product.

4. The product packaging of claim 1, wherein the intermediate panel is formed at least in part by removing material along fold lines thereof.

5. The product packaging of claim 1, wherein the intermediate panel is formed at least in part by mitre cuts extending along fold lines thereof.

6. The product packaging of claim 1, wherein corners of the spacing segment are formed at least in part along mitre cuts in material of the intermediate panel.

7. The product packaging of claim 6, wherein the mitre cuts do not extend through the entirety of the intermediate panel.

8. The product packaging of claim 1, further comprising at least one retention member formed of and protruding from the rear panel.

9. The product packaging of claim 8, wherein the retention member forms an arm that includes an undercut portion.

10. The product packaging of claim 8, wherein the at least one retention member comprises a portion of an adhesive film that extends onto the rear panel.

11. The product packaging of claim 1, wherein the rear panel is flat, wherein the front panel is curved, and wherein the front panel and the rear panel are attached along their peripheries.

12. The product packaging of claim 1, further comprising a pull tab adhered within the product-receiving recess.

13. The product packaging of claim 12, further comprising a dual-layer adhesive, wherein the pull tab is adhered to the rear panel by the dual-layer adhesive, and wherein the dual-layer adhesive is covered in part by an adhesive deadening.

14. The product packaging of claim 12, further comprising a cushioning layer disposed on the spacing segment.

15. The product packaging of claim 14, wherein the cushioning layer is silicone.

16. The product packaging of claim 12, wherein ends of the spacing segment are rounded.

17. The product packaging of claim 1, wherein each panel is formed entirely from a flat sheet of paper.

18. The product packaging of claim 1, further comprising:

a second rear panel;

a second front panel coupled to the second rear panel; and a second intermediate panel disposed between the second front panel and the second rear panel, wherein the second intermediate panel comprises a spacing segment that spaces a lip portion of the second front panel away from the second rear panel, wherein the intermediate panel defines a second product-receiving recess, and wherein the rear panel and the second rear panel are rotatably coupled to each other along edges thereof.

19. The product packaging of claim 1, wherein the front panel is rigidly coupled to the rear panel.

20. Product packaging, comprising:

two segments, each formed by one or more sheets, each segment comprising:

a pocket for retaining and displaying a product, the pocket including an opening sized and dimensioned to receive the product, wherein the opening has a lip that overhangs a perimeter of the pocket in order to retain the product within the pocket, and wherein the first segment and the second segment are rotatably coupled to each other along edges thereof.

21. The product packaging of claim 20, further comprising at least one retention member disposed in the pocket.

22. The product packaging of claim 20, wherein each sheet is formed entirely from a flat sheet of paper.

23. The product packaging of claim 20, wherein the opening exposes a majority of the pocket.

24. Product packaging, comprising:

a rear panel;

a front panel coupled to the rear panel;

an intermediate panel disposed between the rear panel and the front panel, the intermediate panel forming a product-receiving recess; and a retention member disposed within the product-receiving recess, wherein the retention member forms an arm that includes an undercut portion.

25. The product packaging of claim 24, wherein the retention members are formed from a fold in the first rear panel.

26. The product packaging of claim 24, further comprising:

a second front panel coupled to the rear panel; and a second intermediate panel disposed between the rear panel and the second front panel, wherein the rear panel forms a connector panel that connects the front panel to the second front panel.

27. The product packaging of claim 26 wherein the rear panel is formed from a single film or sheet.

28. The product packaging of claim 26, further comprising a cover panel, wherein the rear panel forms a second connector panel that connects the second front panel to the cover panel.

29. The product packaging of claim 24, wherein the rear panel is flat, wherein the front panel is curved, and wherein the front panel and the rear panel are attached along their peripheries.

30. The product packaging of claim 24, wherein each panel is formed entirely of paper.

31. The product packaging of claim 24, wherein the front panel comprises an opening over a majority of the product-receiving recess.

* * * * *